United States Patent [19]

Ainsworth et al.

[11] Patent Number: 4,569,082

[45] Date of Patent: Feb. 4, 1986

[54] BAG CONSTRUCTION WITH INFLATABLE BLADDER

[76] Inventors: Kathryn L. Ainsworth, 41 Mill St., Newport, R.I. 02840; Catherine M. Papa, P.O. Box 632, Jamestown, R.I. 02835

[21] Appl. No.: 681,097

[22] Filed: Dec. 13, 1984

[51] Int. Cl.[4] ..... A45C 7/00; A45C 13/02; B65D 81/02

[52] U.S. Cl. ..... 383/3; 383/110; 150/106; 150/113; 190/107; 206/522; 206/581; 206/594

[58] Field of Search ..... 383/3, 4, 110, 2; 190/110, 103, 1, 100, 102, 107, 125; 206/522, 521, 594, 581; 150/106, 113, 129, 52 E

[56] References Cited

U.S. PATENT DOCUMENTS

| | | | |
|---|---|---|---|
| 407,625 | 7/1889 | Valdiuielso | 383/3 X |
| 1,300,921 | 4/1919 | Briggs | 190/110 |
| 1,927,471 | 9/1933 | Salomon | 383/3 X |
| 2,542,477 | 2/1951 | Cart | 383/3 X |
| 3,319,685 | 5/1967 | Urban | 206/522 X |
| 3,587,794 | 6/1971 | Mattel | 383/3 X |
| 3,651,847 | 3/1972 | Casamassima | 383/3 |
| 3,763,972 | 10/1973 | Karzmar | 383/110 X |
| 3,889,743 | 6/1975 | Presnick | 206/522 X |
| 3,891,082 | 6/1975 | Fall | 383/3 X |
| 3,990,495 | 11/1976 | Labarba | 383/110 |
| 4,044,867 | 8/1977 | Fisher | 383/3 X |
| 4,155,453 | 5/1979 | Ono | 383/3 X |
| 4,164,970 | 8/1979 | Jordan | 383/3 |
| 4,184,596 | 1/1980 | Avery | 383/3 X |
| 4,190,158 | 2/1980 | Ambrose | 206/522 |
| 4,215,778 | 8/1980 | Kovins | 206/522 X |
| 4,262,801 | 4/1981 | Avery | 383/3 X |
| 4,506,769 | 3/1985 | Franco et al. | 190/110 X |

FOREIGN PATENT DOCUMENTS

| | | | |
|---|---|---|---|
| 2218759 | 10/1973 | Fed. Rep. of Germany | 206/522 |
| 2754061 | 6/1979 | Fed. Rep. of Germany | 206/522 |
| 325233 | 4/1903 | France | 206/522 |
| 2385606 | 12/1978 | France | 206/522 |
| 2417448 | 10/1979 | France | 206/522 |

*Primary Examiner*—William Price
*Assistant Examiner*—Sue A. Weaver
*Attorney, Agent, or Firm*—Salter & Michaelson

[57] ABSTRACT

A bag construction comprising an outer casing portion having a plurality of flexible outer walls, an inflatable bladder removably received in the casing portion, and preferably also a pocket element or the like for receiving articles in the bag and positioning them adjacent the bladder. The inflatable bladder acts to effectively cushion and protect the articles contained in the pocket element and hence the bag can be utilized for transporting relatively fragile articles, such as bottles containing cosmetics and the like in the pocket element. The bladder is inflatable from the exterior of the bag and it is removable from the casing portion to permit the use of the bag without the bladder and to facilitate the cleaning of the bag.

6 Claims, 7 Drawing Figures

10
20
12
22
32
32
4
28
36
30
48
30
46
40
4
26
35

20
12
32
30
38
16
14
30
38
30
52
22
50
52
32
40
30
26
16

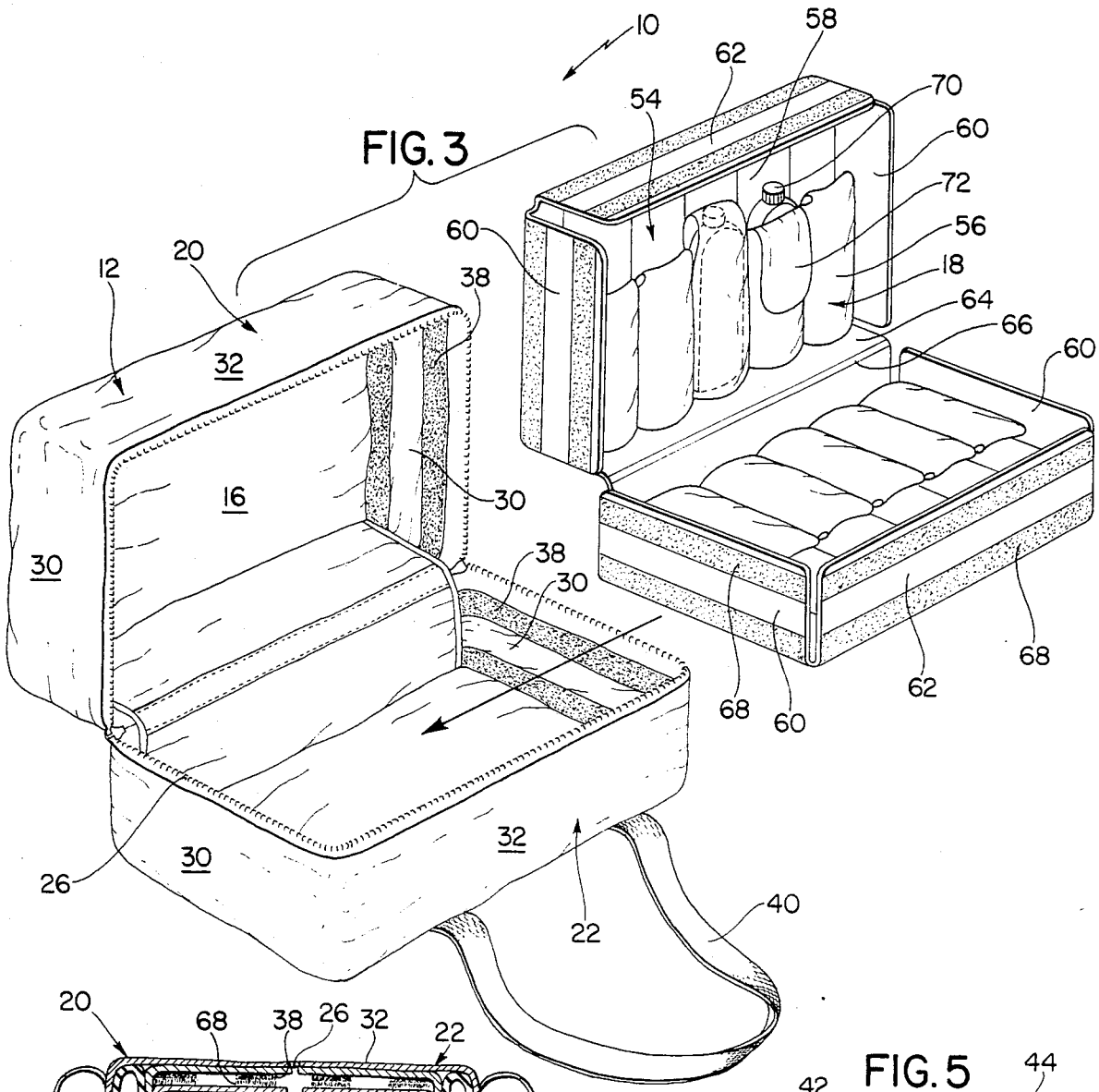
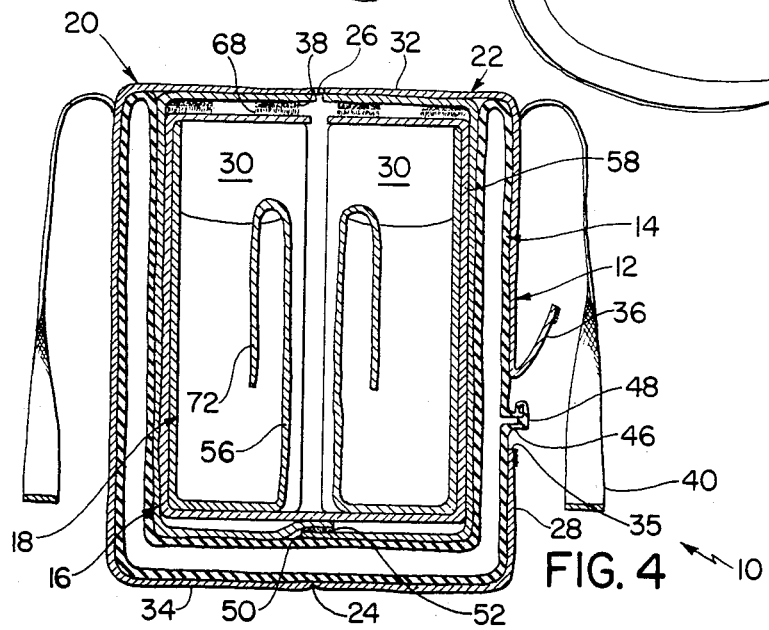
FIG. 4
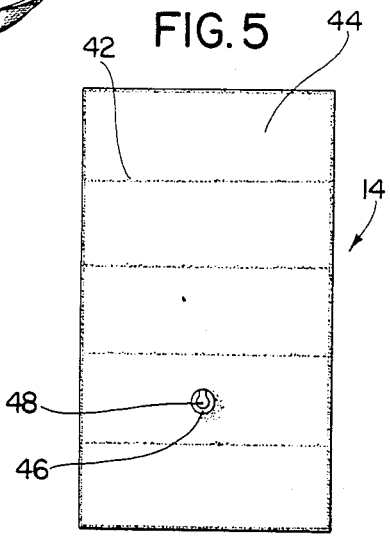

FIG. 6
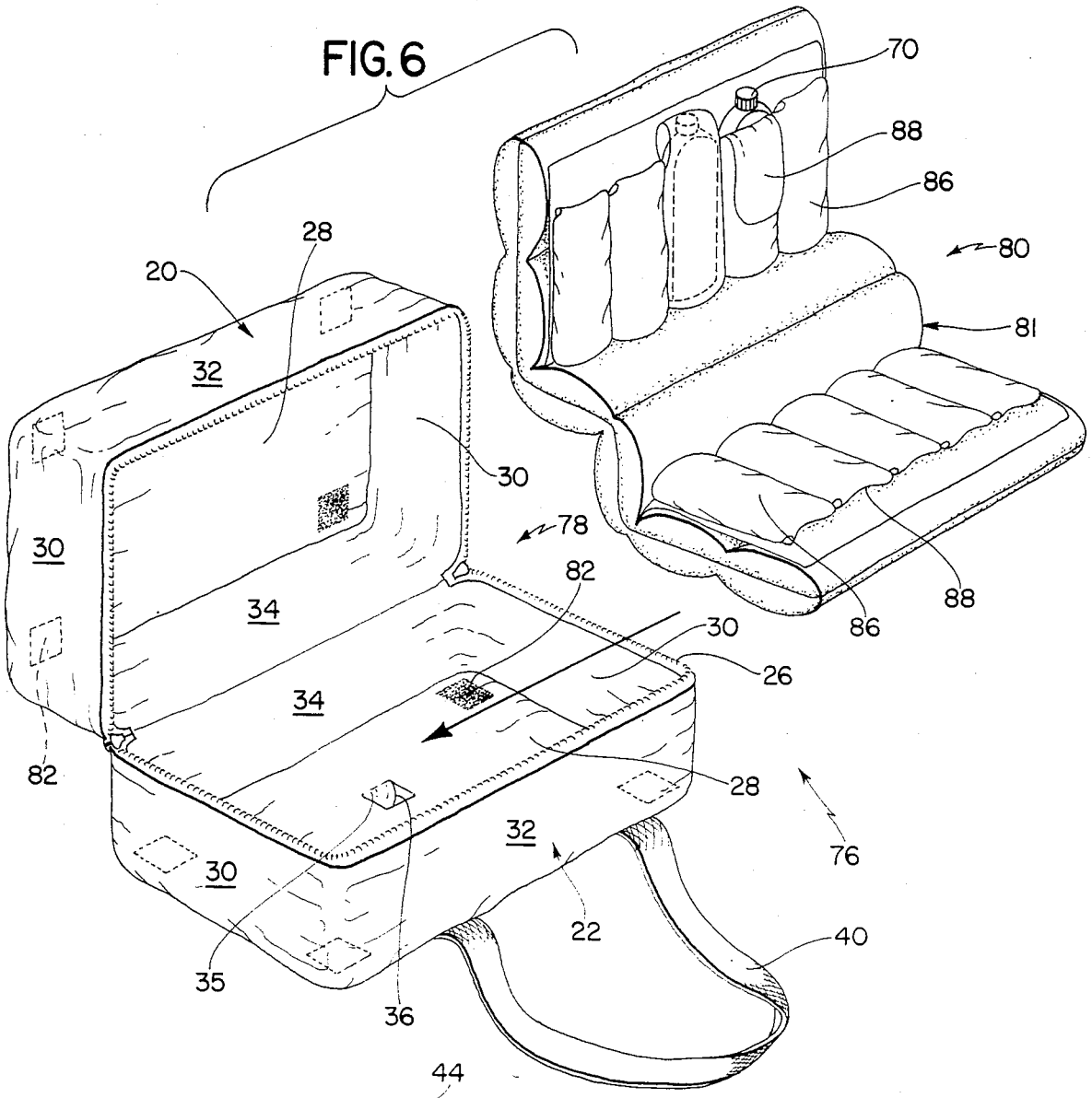
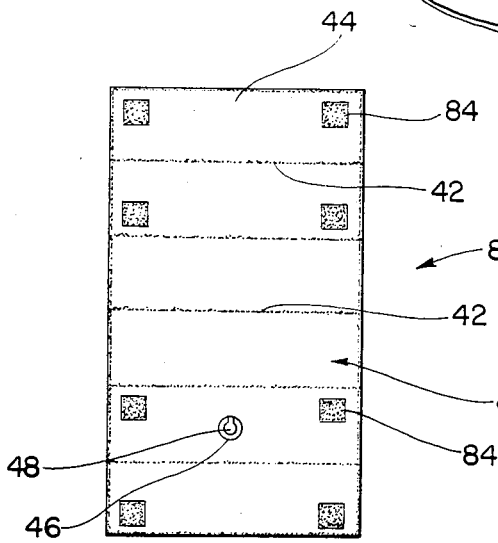
FIG. 7

BAG CONSTRUCTION WITH INFLATABLE BLADDER

BACKGROUND AND SUMMARY OF THE INVENTION

The instant invention relates to luggage and more particularly to a bag construction which is adapted for use in transporting relatively fragile articles, such as bottles containing cosmetics and the like.

Heretofore, breakage has frequently been a problem when relatively fragile articles, such as bottles containing cosmetics and the like, have been transported in various forms of mass transportation, such as airlines, trains and buses. In this regard, although various types of rugged suit cases and luggage have been heretofore utilized for this purpose, in many cases even the most rugged suitcases and luggage have failed to provide adequate protection for delicate articles contained therein when the suitcases have been handled by baggage handling systems on airlines, etc. Further, when suitcases are made in relatively rugged constructions, they are inherently relatively heavy, and as a result, it is often impractical for travelers to carry rugged suitcases to protect their delicate articles. While lightweight duffel bags or other types of "soft" luggage made of fabrics and the like have also been heretofore available, they have generally failed to provided any significant protection for articles contained therein and, hence heretofore it has also not been practical to use "soft" luggage for transporting relatively fragile articles on mass transportation systems. In this connection, although, some types of "soft" bag constructions have been heretofore available which have included inflatable members for protecting and cushioning articles contained therein, generally these bag constructions have been limited in their versatility and they have not been effective for transporting many types of articles.

Bags and containers representing the closest prior art to the invention of which the applicant is aware are disclosed in the U.S. Pat. Nos. to Cart, No. 2,542,477; to Mattel, No. 3,587,794, to Fall, No. 3,891,082; to Fisher, No. 4,044,867; to Ono, No. 4,155,453; to Jordan, No. 4,164,970; to Avery, No. 4,184,596; to Ambrose, No. 4,190,158; to Kovins, No. 4,215,778; and to Avery, No. 4,262,801. However, because these patents fail to disclose or suggest a bag construction having an inflatable bladder for protecting and cushioning articles contained therein, wherein the bladder is removable from the bag, and because they also fail to disclose or suggest many of the more specific features of the bag construction of the instant invention, they are believed to be of only general interest.

The bag construction of the instant invention comprises an outer casing portion having a plurality of flexible outer walls, wherein the casing portion is alternatively positionable in open and closed positions to define open and closed positions of the bag, respectively, an inflatable bladder which is removably received in the casing portion and positioned therein adjacent at least one of the outer walls, and means for removably retaining the bladder in the casing portion. In one embodiment, the means for retaining the bladder in the casing portion comprises a flexible inner wall which cooperates with the casing portion to define an interior compartment for the bladder, the inner wall having an opening therein for removing the bladder from the compartment when desired. In another embodiment, the means for retaining the bladder in the casing portion comprises means for detachably securing the bladder to the walls of the casing portion. Preferably, one of the outer walls of the casing portion has an opening therein and the bladder is inflatable through the opening in the outer wall to permit of the bladder to be inflated from the exterior of the bag and a flap is provided on the exterior of the casing portion for covering the opening in the outer wall after the bladder as been inflated. In one embodiment, the bag further comprises a removable insert which is detachably received in the casing portion adjacent the bladder and which has a plurality of pockets therein for receiving and positioning articles in the bag so that they are disposed adjacent to and cushioned by the bladder. In another embodiment a plurality of pockets are secured on the inner side of the bladder for receiving and containing articles therein. As a result of the above features, the instant invention provides an effective, light weight, bag construction for containing and transporting relatively fragile articles. Articles can be positioned in the pockets in a bag so that they are protected and cushioned by the bladder of the bag as they are transported. The bladder of a base can be inflated from the exterior of the bag, and when desired, the bladder can be removed from the bag to permit the use of the bag as a conventional duffel bag for transporting more durable articles.

It is, therefore, a primary object of the instant invention to provide an effective lightweight bag construction which can be utilized for transporting relatively fragile articles, such as bottles containing cosmetics and the like.

Another object of the instant invention is to provide an effective bag construction comprising an inflatable bladder, wherein the bladder is removable to permit the use of the bag construction as a conventional duffel bag.

Another object of the instant invention is to provide a bag construction comprising an inflatable bladder, wherein the bladder is inflatable from the exterior of the bag.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a perspective view of the bag with the insert removed from the casing portion;

FIG. 4 is a sectional view taken along line 4—4 in FIG. 1;

FIG. 5 is a plan view of the bladder of the first embodiment of the bag in an inflated disposition;

FIG. 6 is an exploded perspective view of a second embodiment of the bag of the instant invention; and FIG. 7 is a plan view of the bladder of the second embodiment.

DESCRIPTION OF THE INVENTION

Figure 1:
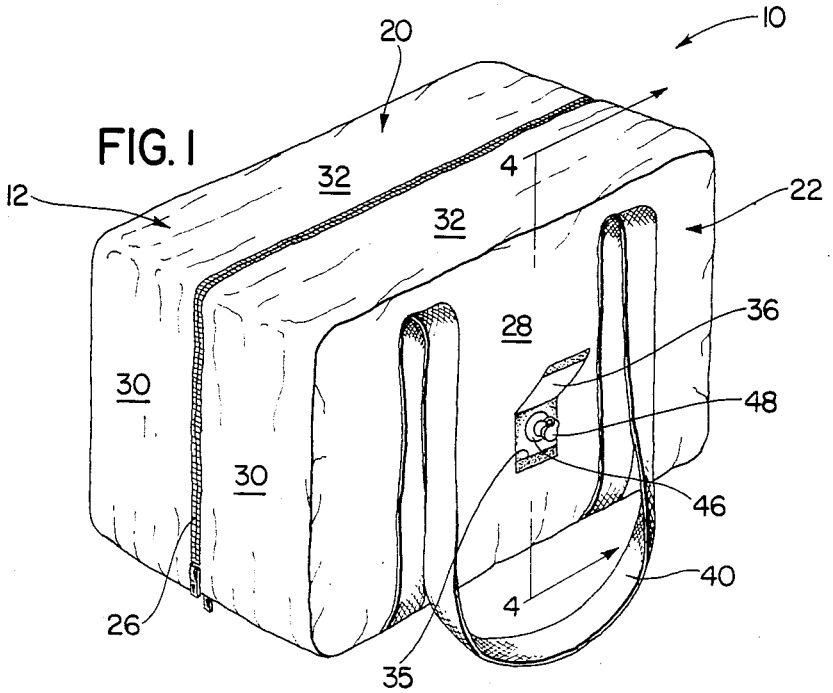
FIG. 1 is a perspective view of a first embodiment of the bag in the closed position.

Referring now to the drawings, a first embodiment of the bag construction of the instant invention is illustrated and generally indicated at 10 in FIGS. 1, 3 and 4. The bag 10 comprises an outer casing portion generally indicated at 12, an inflatable bladder generally indicated at 14 which is received in the casing portion 12, an inner wall 16 for retaining the bladder 14 in the casing portion 12, and an insert generally indicated at 18 which is removably received in the casing portion 12 and is operative for positioning articles in the bag 10 so that they are located adjacent to and cushioned by the bladder 14.

Figure 2:
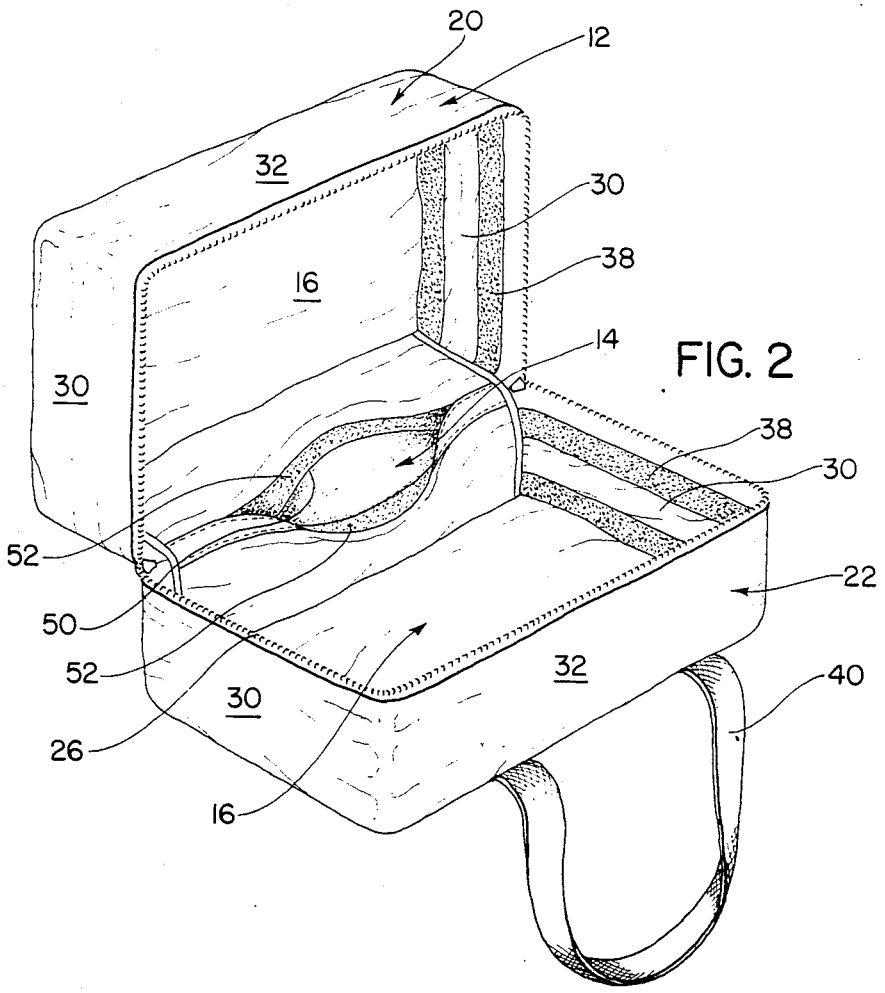
FIG. 2 is a perspective view of the bag in the open position without the insert and with the opening in the inner wall of the bag in an open condition.

The casing portion 12 is preferably made of a flexible canvas or nylon material and it comprises a plurality of flexible outer walls which cooperate to substantially define the outer configuration of the bag 10. More specifically, the casing portion 12 as herein embodied comprises first and second halves generally indicated at 20 and 22, respectively, which are hingeable by at least approximately 90° along a fold line 24 between the open and closed positions thereof, illustrated in FIGS. 1 and 2, respectively, and it is securable in the closed position by means of a zipper 26. The first and second halves 20 and 22 each comprise a substantially rectangular main side wall 28, a pair of end walls 30, a top wall 32, and a bottom wall 34, the respective walls 28, 30, 32, and 34 cooperating to define a substantially open box-like configuration in each of the halves 20 and 22. The zipper 26 extends along the edges of the top and end walls 30 and 32, respectively, for securing the halves 20 and 22 in the closed position, and the bottom walls 34 are integrally connected along the fold line 24. Accordingly, the halves 20 and 22 are hingeable between the open position of the casing portion 12 illustrated in FIG. 2 and the closed position thereof illustrated in FIG. 1, wherein the end walls 30 and the top walls 32 of the two halves 20 and 22 are adjacent one another, and they are securable in the closed position by means of the zipper 26. An opening 35 is provided in the side wall 28 of the half 22 for inflating the bladder 14 and a flap 36 is attached to the side wall 28 of the half 22 adjacent the opening 35 for removably covering the opening 35. Provided along the interior sides of the end walls 30 and the top walls 32 are Velcro (Velcro USA, Inc. TM) strips 38 and carrying straps 40 are secured to the exterior sides of the main walls 28 and the bottom walls 34.

The bladder 14 is illustrated most clearly in FIG. 5 and it comprises a flexible inflatable member which is preferably constructed of a suitable air tight rubberized material. The bladder 14 is preferably made in a substantially rectangular configuration and it is preferably dimensioned so that it is receivable in the casing portion 12 so that it extends along the inner sides of the main side walls 28 and the bottom walls 34. The bladder 14 is preferably formed with a plurality of seams 42 therein which define a plurality of inflatable sections 44 for preventing the bladder 14 from being overinflated in the central portion thereof without reducing the flexibility of the bladder 14. The bladder 14 further comprises a nipple 46 for inflating the bladder 14 and a plug 48 for maintaining it in an inflated disposition, the nipple 46 communicating with the exterior of the bag 10 through the opening 35 when the bladder 14 is received in the casing portion 12.

The inner wall 16 is also preferably constructed of a suitable flexible nylon or canvas material and it is mounted in the casing portion 12 so that it cooperates with the main side walls 28 and the bottom walls 34 to define an inner compartment for the bladder 14 in the bag 10. In this regard, preferably the inner wall 16 is secured to the side walls 28 along the respective attached end walls 30 and top walls 32, and preferably it is provided with an elongated opening or slit 50 therein which is disposed adjacent the fold line 24. Velcro (Velcro USA TM) strips 52 are provided on the inner wall 16 adjacent the slit 50 for detachably maintaining the slit 50 in a closed position.

The insert 18 is most clearly illustrated in FIG. 3 and it comprises an insert wall portion generally indicated at 54 and a plurality of pocket elements 56 which are secured to the wall portion 54. The insert wall portion 54 is dimensioned and configured to be received in the interior of the casing portion 12 and it comprises a pair of substantially rectangular main side wall portions 58, and a pair of end wall portions 60, a top wall portion 62, and a bottom wall portion 64 extend from each of the side wall portions 58 as illustrated in FIG. 3. The bottom wall portions 64 are hingeably interconnected along a fold line 66 and Velcro (Velcro USA TM) strips 68 are provided on the exterior sides of the end walls 60 and the top walls 62, the strips 68 being interengageable with the strips 38 when the insert 18 is received in the casing portion 12 to secure the insert 18 therein. The pocket elements 56 are preferably secured to the side walls 58 and they are preferably dimensioned and configured to receive elements, such as cosmetics bottles 70 or the like therein. In this regard, preferably the pocket elements 56 are sealed to the side walls 58 to contain inadvertent leakage from the bottles 70 and preferably they are made of a transparent plastic material so that the bottles 70 or other articles contained therein can be identified without removing them from the pockets 56. Flaps 72 are provided on the walls 58 adjacent the pockets 56 for retaining the bottles 70 or other articles therein.

For use of the bag 10 with the bladder 14, the bladder 14 is inflated by lifting the flap 36 and supplying air or another gas, such as $Co_2$, to the interior of the bladder 14 through the nipple 46, and thereafter the plug 48 is positioned in the nipple 46 to retain the air or other gas in the bladder 14. In this regard, because the bladder 14 can be inflated from the exterior of the bag 10, the bladder 14 can be inflated without removing or disturbing the insert 18 and it can even be inflated when the casing portion 12 is in the closed position. In any event, articles, such as the cosmetics bottles 70, can be transported in the bag 10 by placing them in the pockets 56, moving the bag 10 to the closed position illustrated in FIG. 1, and moving the zipper 26 to an engaged position to retain the halves 20 and 22 in the closed position. When the bag 10 is used in this manner, the insert 18 operates to position the articles contained in the pockets 56 so that they are adjacent the bladder 14 and as a result, the articles are cushioned by the inflated bladder 14. This permits the articles contained in the pockets 56 to be safely transported without substantial risks of breakage under most circumstances and it makes the bag 10 particularly attractive for use in transporting articles, such as bottles containing cosmetics and the like, although the use of the bag 10 for transporting a variety of other types of articles is contemplated. The insert 18 is removable from the casing portion 12 for replacement with a similar insert which is adapted for carrying other types of articles therein or for use of the bag 10 without an insert therein. The bladder 14 may also be removed from the casing portion 12 by separating the Velcro strips 52 and removing the bladder 14 through the slit 50. This permits the use of the bag 10 without the bladder 14 and the insert 18 in a manner similar to a conventional collapsible duffel bag for transporting more durable articles, such as clothing and the like and it also facilitates the cleaning or laundering of the bag 10.

A second embodiment of the bag construction of the instant invention is illustrated in FIG. 6 and generally indicated at 76. The bag construction 76 comprises a casing portion 78 and a bladder portion 80, the bladder portion 80 including an inflatable element 81 and also being illustrated in FIG. 7. The casing portion 78 is similar in configuration to the casing portion 12 and it includes the halves 20 and 22, each of which comprises a substantially rectangular main side wall 28, a pair of end walls 30, a top wall 32 and a bottom wall 34. The half 22 has an opening 35 in the side wall 28 thereof, and a flap 36 is provided for detachably covering the opening 35. Also included in the halves 20 and 22 are Velcro (Velcro U.S.A. TM) patches 82 which are located adjacent the corners of the walls 28 on the inner sides of the halves 20 and 22. As will be noted, however, the bag 76 does not include the strips 38 on the halves 20 and 22, nor does it include the inner wall 16 as does the bag 10. The inflatable element 81 is generally similar in configuration to the bladder 14, although it is preferably formed with an even number of inflatable sections 44 so that the bladder 80 is hingeable or bendable by at least approximately 90° about a seam 42 which is located in substantially the midpoint of its longitudinal extent. The inflatable element 81 also includes a nipple 46 for inflating the sections 44 and a plug 48 for maintaining the inflatable element 81 in an inflated disposition. A plurality of Velcro (Velcro U.S.A. TM) patches 84 are included in the bladder 80 on the back or rear side of the inflatable element 81 for securing the bladder 80 in the casing portion 78, the patches 84 being located so that they are interengageable with the patches 82 in the halves 20 and 22 when the bladder 80 is received in the casing portion 78. The nipple 46 and the plug 48 are located so that they communicate with the opening 35 when the bladder 80 is received in the casing portion 78 to permit the inflatable element 81 to be inflated from the exterior of the bag 78. As illustrated most clearly in FIG. 6, the bladder 80 also includes a plurality of pocket elements 86 which have closure flaps 88 and are secured on the inner side of the inflatable element 81 for receiving articles such as cosmetic bottles 70 and for positioning them in the bag 76 so that they are cushioned by the inflatable element 81. In this regard, it will be understood that a variety of different constructions and configurations for the pockets 86 and the flaps 88 are contemplated in order to adapt the bag 78 for receiving and transporting articles of various configurations so that they are protected by the inflatable element 81.

The bag 76 is operable in a manner similar to the bag 10 for transporting relatively fragile articles. The inflatable element 81 can be inflated through the aperture 35 without removing the bladder 80 from the casing portion 78 and articles which are received in the pockets 86 are effectively protected by the inflatable element 81. The bladder 80 is dimensioned and configured so that when it is received in the casing portion 78 a first section of the bladder 80 substantially covers the inner side of a first of the main side walls 28 and so that a second section of the bladder 80 substantially covers the inner side of a second of the inner side walls 28. Further, the bladder 80 is normally retained in the casing portion 78 so that the first section of the bladder 80 is positioned in substantially aligned covering relation with the inner side of the respective adjacent main side wall 28 and so that the second section of the bladder 80 is also positioned in substantially aligned covering relation with the inner side of the respective adjacent main side wall 28. The bladder 80 is, however, removable from the casing portion 78 by separating the patches 82 from the patches 84 to permit the use of the casing portion 78 as a conventional collapsible duffel bag, and to facilitate the cleaning and laundering of the bag 76. In this regard, since the pockets 86 are formed on the inflatable element 81, a separate insert, such as the insert 18 is not required in the bag 76 and the entire inner portion of the bag 76 can be removed by removing the bladder 80 from the casing portion 78.

It is seen therefore that the instant invention provides an effective bag construction which can be utilized for safely transporting relatively fragile articles, such as cosmetics contained in bottles and the like. The bladders 14 and 80 provide effective means for protecting articles contained in the pockets 56 and 86, respectively, as they are transported. The insert 18 effectively positions articles in the pockets 56 adjacent the bladder 14 in the bag 10, whereas in the bag 76 the pockets 86 are formed as part of the bladder 80. Hence, the bags 10 and 76 can generally be effectively utilized for transporting relatively fragile articles over mass transit systems, wherein luggage may be subjected to relatively rough handling, without concern with regard to breakage. The bag 10 can also be utilized without the insert 18 for transporting other types of delicate articles, and it can be utilized as a conventional duffel bag by removing the bladder 14 from the compartment defined by the casing portion 12 and the inner wall 16. The bag 76 can also be utilized as a conventional duffel bag by removing the bladder 80. Accordingly, for these reasons as well as the other reasons hereinabove set forth it is seen that the bag construction of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bag construction comprising:

a. a flexible and collapsible outer casing having hingeably connected first and second casing portion halves comprising first and second enlarged flexible main side walls, respectively, said casing portion halves being selectively hingeable with respect to each other by at least approximately 90° between open and closed positions for defining open and closed positions of said bag, said flexible main side walls defining opposite sides of said bag when said bag is in the closed position thereof;

b. inflatable bladder means in said casing portion, said bladder means comprising inflatable first and second sections each having inner and outer sides, the outer sides of said first and second bladder means sections being of substantially the same dimension and configuration as the inner sides of said first and second main side walls, respectively, and being mounted in said casing so that said first and second bladder means sections are hingeable by at least approxiately 90° with said first and second casing portion halves, respectively;

c. releasable fastening means removably retaining said first and second bladder means sections in said casing portion so that the outer sides of said first and second bladder means sections are disposed adjacent the inner sides of said first and second main side walls, respectively, and in substantially aligned relation therewith, respectively;

d. a plurality of flexible pocket elements mounted in said casing adjacent to the inner side of at least one of said bladder means sections, so that articles received in said pocket elements are positioned in cushioned relation with said adjacent bladder means section and are interposed between said first and second bladder means sections; and e. means securing said pocket elements on the inner side of said adjacent bladder means section so that they are hingeable therewith.

2. The bag of claim 1 further comprising a plurality of pocket elements mounted adjacent to the inner side of each of said first and second bladder means sections, said securing means securing said pocket elements on the inner sides of their adjacent bladder means sections, respectively, so that they are hingeable therewith.

3. In the bag of claim 1, said securing means removably securing said pocket elements in said casing.

4. In the bag of claim 1, said securing means permanently securing said pocket elements to the inner side of said adjacent bladder means section.

5. In the bag of claim 2, said securing means removably securing said pocket elements in said casing.

6. In the bag of claim 2, said securing means permanently securing said pocket elements to the inner side of said adjacent bladder means section.

* * * * *